US005863022A

United States Patent [19]

Van Winkle

[11] Patent Number: 5,863,022

[45] Date of Patent: Jan. 26, 1999

[54] STRIPPER/PACKER AND BLOWOUT PREVENTER WITH SPLIT BONNET

[76] Inventor: D. Wayne Van Winkle, P.O. Box 2327, Conroe, Tex. 77305-2327

[21] Appl. No.: 693,976

[22] Filed: Aug. 8, 1996

Related U.S. Application Data

[60] Provisional application No. 60/009,946 Jan. 16, 1996.

[51] Int. Cl.[6] ..... E21B 33/06

[52] U.S. Cl. ..... 251/1.1; 251/1.2

[58] Field of Search ..... 251/1.1, 1.2

[56] References Cited

U.S. PATENT DOCUMENTS 3,490,525 1/1970 Nettles ..... 251/1.2 X 3,915,426 10/1975 Le Romax ..... 251/1.2 X

*Primary Examiner*—John Fox

*Attorney, Agent, or Firm*—Gunn & Associates, P.C.

[57] ABSTRACT

A stripper/packer which also serves as a blowout preventer includes a split bonnet. The split bonnet comprises a pair of opposed bonnet halves that may be hydraulically actuated into contact with each other and locked in place to form a bonnet over a packer chamber with the body of the packer. The bonnet halves may be locked together by hydraulic actuation of a latch pin or a pair of pins, or a sleeve may be inserted to hold the bonnet halves together. The split bonnet feature provides clear and easy access to a packer element within the packer chamber with coiled tubing or other tubular member through the packer, or with the coiled tubing withdrawn from the packer.

13 Claims, 5 Drawing Sheets

STRIPPER/PACKER AND BLOWOUT PREVENTER WITH SPLIT BONNET

This application claims the benefit of U.S. Provisional Application No. 60/009,946, filed Jan, 16, 1996.

FIELD OF THE INVENTION

The present invention relates generally to the field of oil field equipment and, more particularly, to a combination stripper/packer and complete shut off blowout preventer (BOP) with a split bonnet. The stripper/packer/BOP of the present invention is particularly adapted for coiled tubing operations, such as drilling.

BACKGROUND OF THE INVENTION

In known oil field systems, coiled tubing operations have generally been performed with small diameter tools available for such operations. As coiled tubing is fed into the hole for operations such as drilling, the drilling or other assembly must pass through a relatively large diameter opening at the well head to pass a string of downhole drilling tools that are larger in diameter than the coiled tubing itself. The well head invariably includes a sealing mechanism such as a stripper/packer that can be closed around the coiled tubing as the coiled tubing is being run in and out of the well.

Packers have been in use in oil and gas wells for many years. A packer is generally used in the stack at the well head to seal off down hole pressure from lower well pressures above the packer so that various operations may be performed safely above the well.

A packer commonly comprises a packer element made of a polymeric material that is somehow deformed to seal between a tubular member extending through the packer and the body of the packer. Known well head devices combine the functions of a packer with a BOP, which serves to completely shut off the well when no drill string or coiled tubing is down hole.

Although the packer element is made of a flexible polymeric material, movement of the tubing through the packer abrades the inner surface of the packer, eventually requiring replacement. Sufficient permanent deformation of the packer element will cause the packer to leak by and the packer element must then be replaced. Replacement of the packer element has been shown to be an expensive and often dangerous operation since the packer element is often retained on top by a one-piece bonnet.

In order to replace the packer element, a large number of hold-down bolts, typically 20 or more such bolts, which secure the one-piece bonnet to the body of the packer, must first be removed. Then, the one-piece bonnet must be lifted vertically clear of the packer body, generally two to several feet, to provide clear access to the packer element so that it can be removed and replaced. This vertical clearance above the packer for access to the packer element is otherwise wasted space between the packer and a coiled tubing injector, increasing the overall vertical height of the well-control apparatus at the well head.

Thus, there remains a need for a stripper/packer which provides space saving above the packer and a quick way to change the packer or sealing element, either while tubing is in the well or with the tubing withdrawn from the well.

Further, there remains a need for a stripper/packer/BOP in which the packer element may be replaced quickly and easily without the need for wasted vertical clearance between the packer and any accessory above the packer, such as a coiled tubing injector. This could most advantageously be achieved by horizontally retracting opposed halves of a split bonnet. There also remains a need for a stripper/packer having a split bonnet that resists movement under the influence of downhole pressures when the bonnet is closed.

Such a stripper/packer should be easily adaptable to stacks currently in use, be simple in construction to minimize the cost of construction and enhance the ease of maintenance. Finally, the packer must securely pack off down hole pressure and work at least as effectively as known packers.

SUMMARY OF THE INVENTION

The present invention solves these and other drawbacks of the prior art by providing a divided, i.e. two-piece, bonnet stripper/packer that can be horizontally retracted to provide easy, direct access to a packer element. The packer of the present invention is particularly adapted for use with coiled tubing, but is equally applicable to other types of piping through a casing down hole.

In order to do this, the present invention includes a split bonnet so that it can be retracted to each side, thereby giving full access to the packing element. This does not increase the height of the unit and does not require additional access room in order to change the packing element. The bonnet is opened by retracting and closed by means of hydraulic operators. The present invention further includes a simple, mechanical, hand-operated locking means to prevent inadvertent opening of the bonnet under well pressure.

When closed, the two-piece bonnet functions as a standard bonnet during coiled tubing operations, such as drilling. But, as the wear on the packer element approaches the maximum allowable loss, the two-piece packer element may be changed quickly, with tubing in the well. Actuating two hydraulic cylinders pulls each bonnet half away from the pressure chamber, exposing the entire packer cavity. Both halves of the packer element may then be replaced quickly, and the hydraulic cylinders are then actuated to close the two-piece bonnet. The coiled tubing operation may then be continued, saving time and money with additional safety for personnel.

The stripper/packer may be installed as the top component of the pressure containing stack of equipment located directly below an injector head. This invention ensures safety and saves time when running production or exploration tubing, connectors, or other components having a larger outside diameter than the tubing on which it is connected, while the tubing is run in or out of the borehole.

The stripper/packer of the present invention includes horizontal actuators that result in a substantial reduction in overall height compared to packers known in the art.

The stripper/packer also permits replacement of the packer and bushings in the open space below the injector head. This makes for easier packer changeout, even with tubing in the well.

In the packer of the present invention, a simple mechanical latch is provided to lock the halves of the bonnet in a closed position. Alternatively, opposed, interleaving flanges on the bonnet may be mated in the closed position, and a manually or hydraulically actuated pin inserted in the flanges to lock the bonnet closed.

These and other features of the present invention will be immediately apparent to those of skill in the art from a review of the following detailed description along with the accompanying drawings.

DETAILED DESCRIPTION OF A PREFERRED EMBODIMENT

Figure 1:
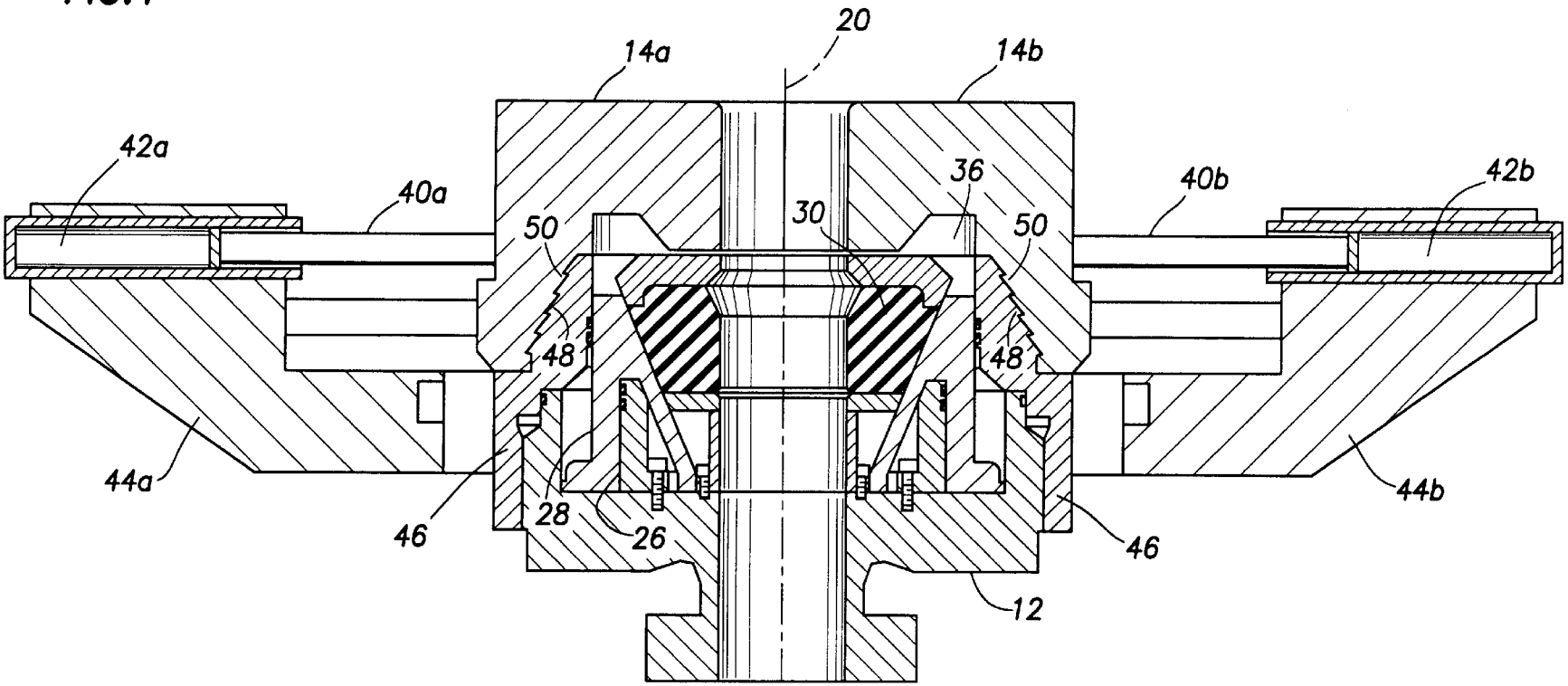
FIG. 1 is an elevation view of the packer of the present invention in partial section, shown in the closed position.

In the drawing figures, like elements are identified with like numbers.

Figure 9:
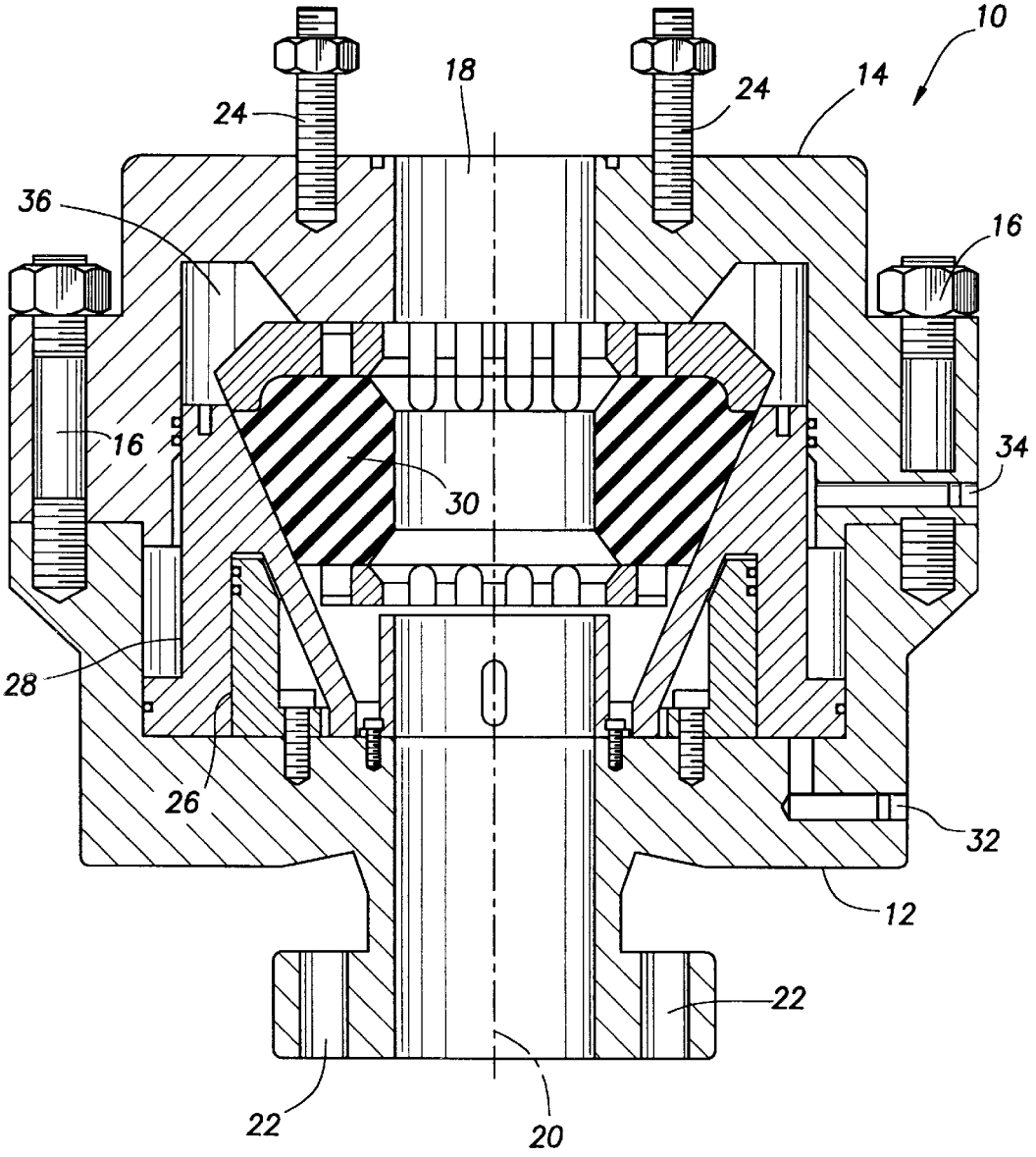
FIG.9 (PRIOR ART)
FIG. 9 is a side section view of a known packer with a one-piece bonnet.

FIG. 9 depicts a known packer 10 adapted to be mounted at a well head for receiving coiled tubing for drilling and other operations. The packer is comprised primarily of a body 12 releasably coupled to a bonnet 14, such as with a plurality of bolts 16. An axial bore 18 along an axis 20 receives a tubular member, such as coiled tubing. The body 12 includes bolt holes 22 to mount the packer to another accessory at the well head and the bonnet 14 includes studs 24 to mount another accessory above the packer.

Retained between the body 12 and the bonnet 14 are a sleeve 26, a piston 28, and a polymeric packer element 30. The piston is actuated by hydraulic fluid under pressure through a port 32 and released by pressure through a port 34. Applying pressure to the port 32 forces the piston 28 up, and inside, conical bowl of the piston squeezes the packer element to seal against the coiled tubing in the bore 18 or to shut off the packer as a BOP.

The stripper/packer/BOP 10 also includes a number of O-rings and other types of seals in a manner well known in the art and these elements are therefore not numbered in the drawing figures.

Once the packer element 30 has reached the end of its useful life and must be replaced, any accessory mounted to the studs 24 must first be removed. Then, the bolts 16 must be removed to release the bonnet from the body. If coiled tubing is in position in the bore 18, the bonnet is then slid upward on the coiled tubing a sufficient distance to provide access to a packing cavity 36. This means that a sufficient clearance must always be provided above the packer 10, even when access is not necessary to work on a packer element.

The present invention, shown in FIGS. 1 through 8, solves these and other drawbacks of the packer of FIG. 9.

Referring to FIG. 1, in the present invention, the bonnet is divided into a first bonnet half 14*a* and a second bonnet half 14*b*. The bonnet half 14*a* is coupled to a rod 40*a* and the bonnet half 14*b* is similarly coupled to a rod 40*b*. The rods 40*a* and 40*b* are actuated by hydraulic cylinders 42*a* and 42*b*, respectively. The hydraulic cylinders 42*a* and 42*b* are mounted to pedestals 44*a* and 44*b* and the pedestals 44*a* and 44*b* are securely coupled to or integral with a body cylinder 46. The body cylinder 46 encloses and guides the piston 28, as described above.

In a preferred embodiment, the body cylinder 46 includes a plurality of retention rings 48, which in profile as shown in FIG. 1 appear as serrations or "saw-tooth" steps. These retention rings mate with similar retention rings or grooves 50 on the bonnet halves 14*a* and 14*b*. With the bonnet halves in a closed position, the grooves 50 form mating retention rings all around the retention rings 48. These mating retention rings 48 and grooves 50 secure the body of the body cylinder to the bonnet halves in the closed position to resist vertical movement of the bonnet halves, while ensuring that the bonnet halves are easily withdrawn to the open position by the rods 40*a* and 40*b* under hydraulic pressure. The use of a plurality of retention rings 48 and grooves 50 provides an efficient means of securing the bonnet and body together, resulting in a smaller diameter packer and bonnet, with concomitant savings in size and weight.

Figure 2:
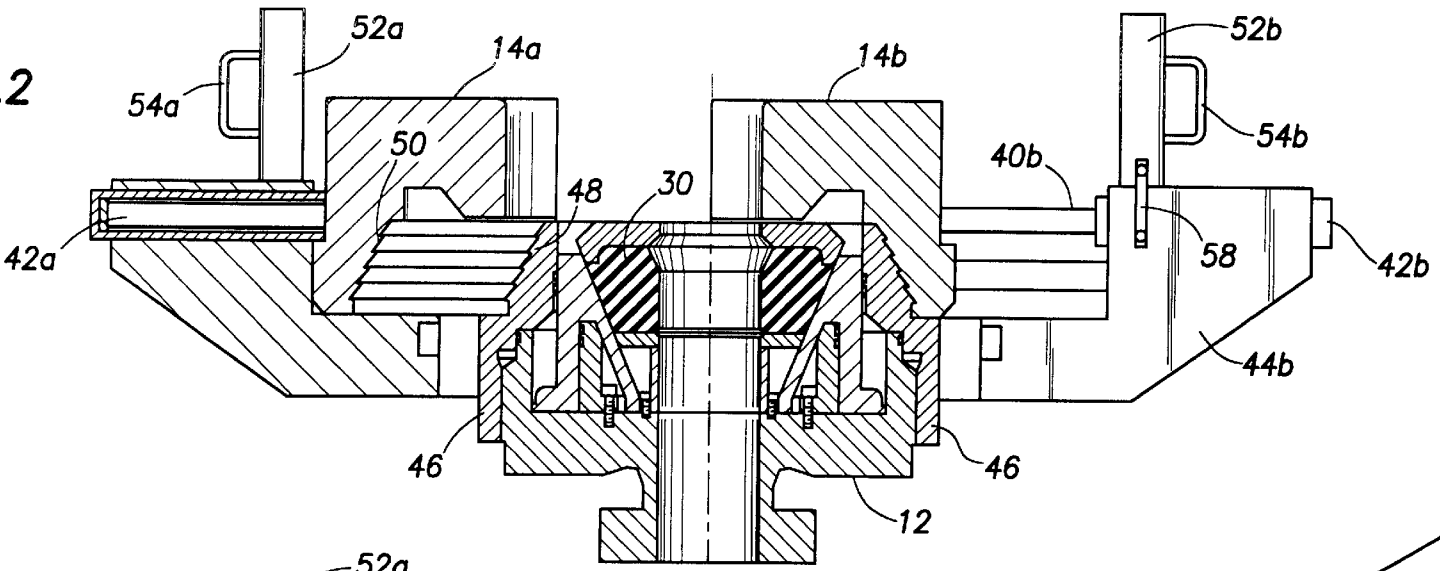
FIG. 2 is an elevation view of the packer of the present invention in partial section, with the left side bonnet half retracted to the open position and the right side bonnet half in the closed position, with a preferred locking mechanism of the invention unlocked.
Figure 3:
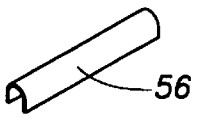
FIG. 3 is a perspective view of a detail of the locking mechanism.

FIG. 2 depicts the packer of the present invention in partial section with the left side bonnet half 14*a* withdrawn to the open position. This view more clearly shows the retention rings 48 separated from the retention rings 50. The packer also includes a pair of locking mechanisms 52*a* and 52*b* for the left and right sides of the packer, respectively. Each of the locking mechanisms 52*a* and 52*b* are shown in FIG. 2 in the unlocked position. The locking mechanisms are preferably provided with handles 54*a* and 54*b*, for manual operation of the locking mechanisms. Each of the locking mechanisms is preferably a semi-cylinder 56, as shown in FIG. 3, although other geometries are equally acceptable. This enables the locking mechanisms to fit over and partially around their respective rods 40*a* and 40*b*.

Note that the locking mechanisms provide a clearly visible flag that the packer is latched or unlatched. In other words, if neither locking mechanism 52*a* or 52*b* is visible in a raised position, then the bonnet halves are clearly shut and locked in place. This is an additional feature of the present invention.

Figure 4:
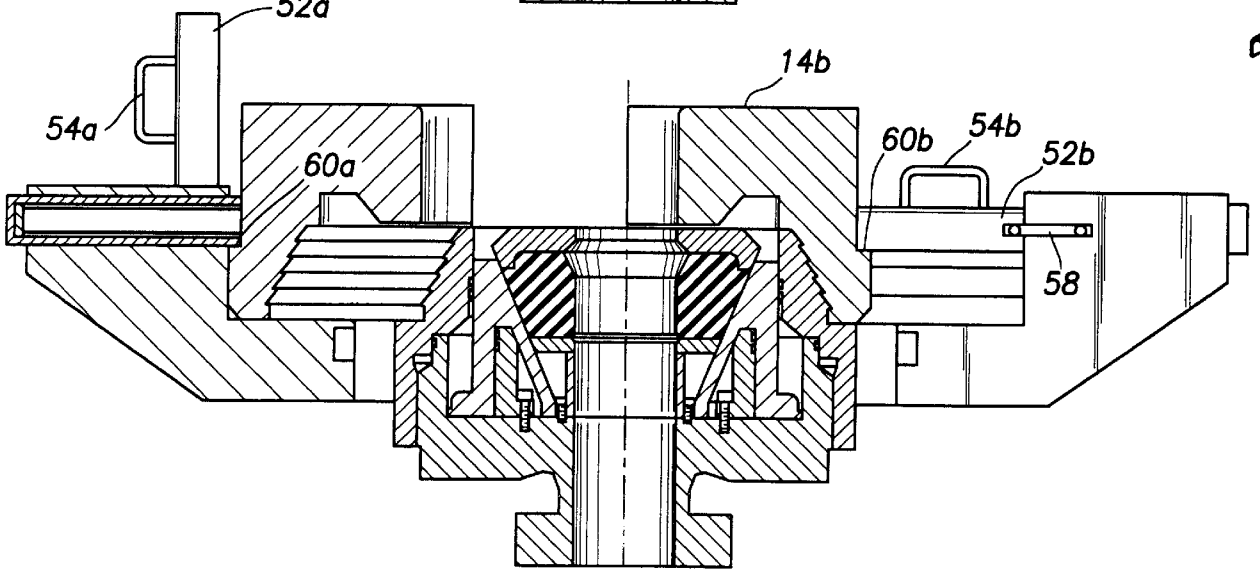
FIG. 4 is an elevation view of the packer of the present invention in partial section, with the left side bonnet half retracted to the open position and the right side bonnet half in the closed position, with a preferred locking mechanism of the invention in the locked position.

The locking mechanisms are preferably secured to their respective pedestals 44*a* or 44*b* by a set of pivot hinges 58. FIG. 4 shows the locking mechanism 52*b* in the locked position, with the pivot hinge 58 horizontally oriented. The locking mechanism 52*b* is thus positioned within a seat 60*b* and a similar seat 60*a* is provided for the left side of the packer. The handle 54*b* is then available to manually lift the locking mechanism.

Figure 5:
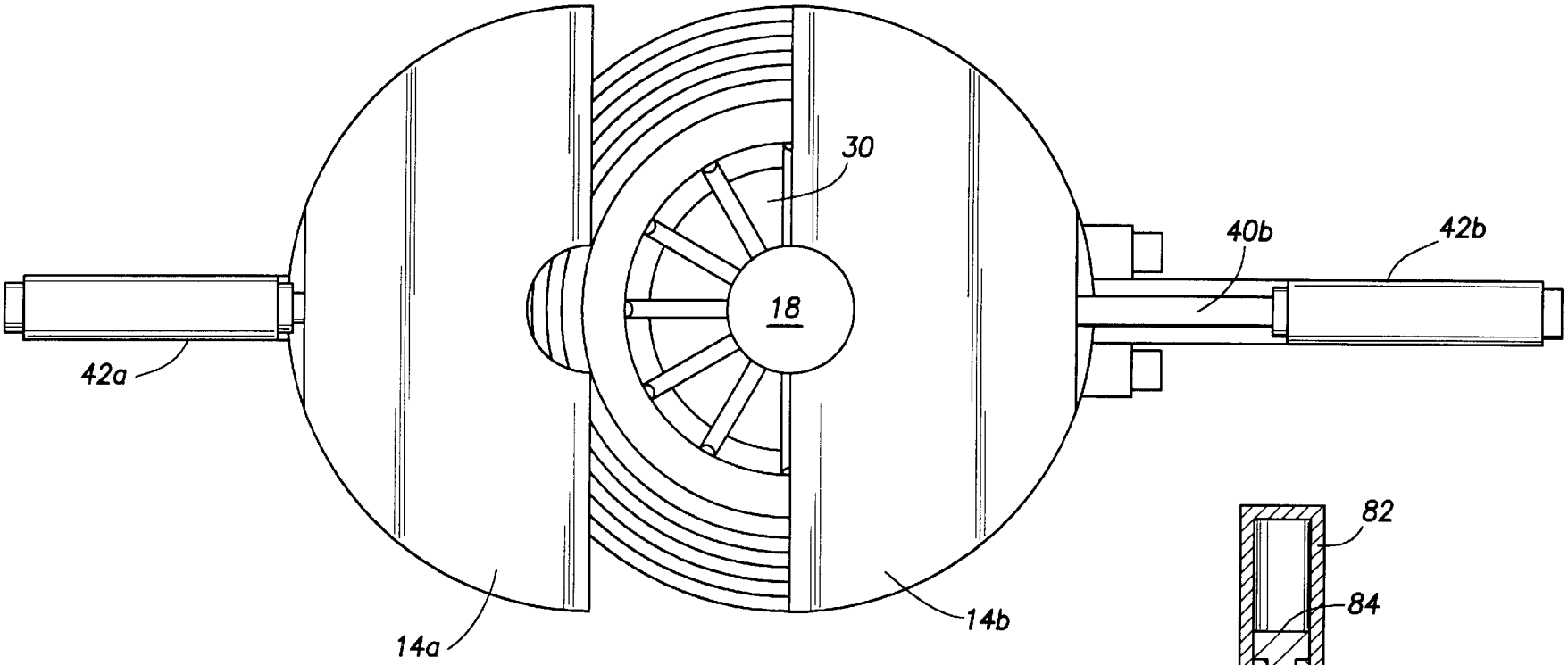
FIG. 5 is a top view of the packer of the present invention with the left side bonnet half retracted and right side bonnet half closed.

FIG. 5 depicts the packer of the present invention in a top view. In this figure, the bonnet half 14*a* is retracted and the bonnet half 14*b* is extended by the extension of the rod 40*b*. The left half of the packer element 30 is visible beneath the bonnet. It should be noted that the packer element is split in half along the lines of the bonnet so that the packer element may also with extracted and replaced with coiled tubing through the bore 18.

Figure 7:
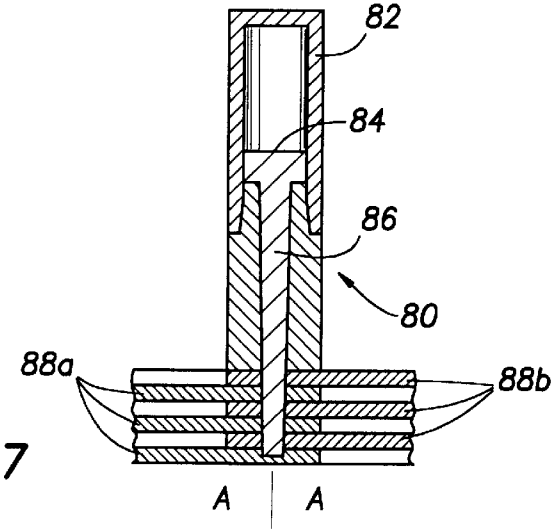
FIG. 7 is a section view of the alternative embodiment of the locking mechanism.
Figure 6:
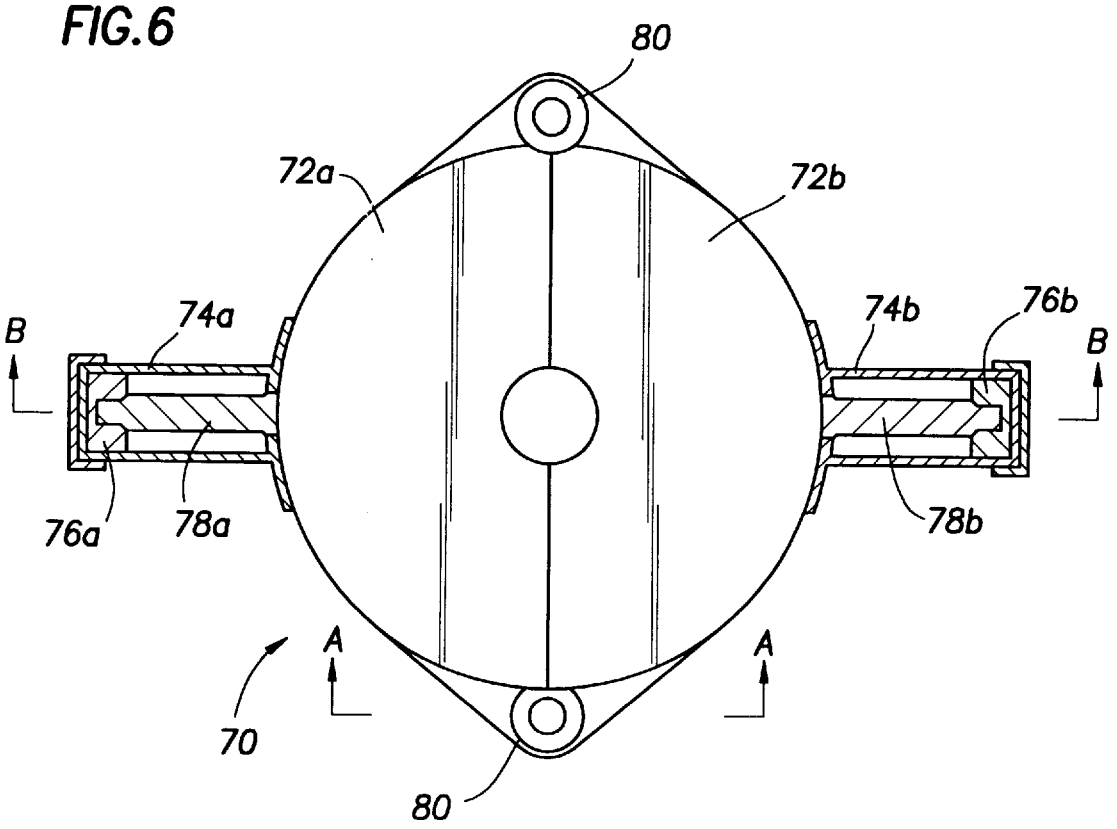
FIG. 6 is a top view of the packer of the present invention depicting an alternative embodiment of the locking mechanism.
Figure 8:
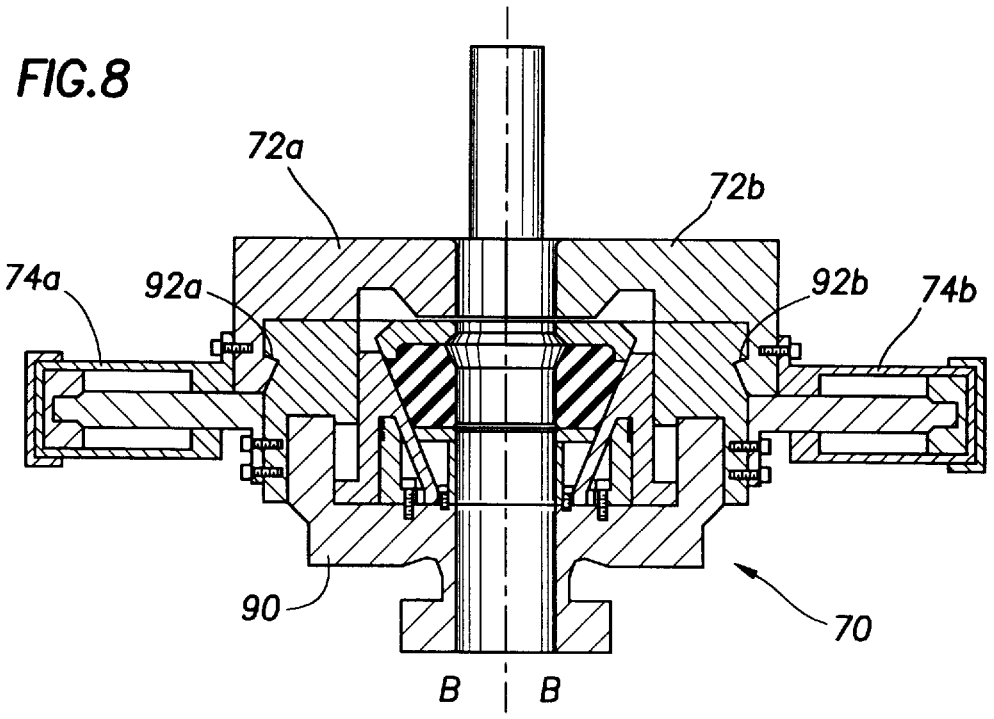
FIG. 8 is a side section view of the packer of the present invention depicting an alternative embodiment of a retention ring.

FIGS. 6, 7, and 8 depict an alternative preferred embodiment of the present invention disclosed in U.S. Provisional Application No. 60/009,946, filed Jan. 16, 1996, of which the present application claims the benefit. FIG. 6 shows a top view of a packer 70 and shows the section lines A—A, which section view is shown in FIG. 7, and section lines B—B, which section view is shown in FIG. 8.

The packer 70 includes a left bonnet half 72*a* and a right bonnet half 72*b*. Actuation of the packer is provided on the left side by a cylinder 74*a*, a piston 76*a*, and a piston rod 78*a*. Actuation of the packer is provided on the right side by a cylinder 74*b*, a piston 76*b*, and a piston rod 78*b*. The packer 70 also includes an interleaved locking mechanism 80, although the locking mechanism of FIGS. 2, 3, and 4 is presently preferred. This locking mechanism is shown in a side section view in FIG. 7.

The locking mechanism 80 includes a hydraulic cylinder 82, a piston 84, and a connected tapered wedge 86. The bonnet half 72*a* includes a number of extension plates 88*a* and the bonnet half 72*b* includes extension plates 88*b*. With the bonnet halves closed, holes in the extension plates 88*a* and 88*b* line up, and under hydraulic pressure the tapered wedge 86 is forced down through the holes to lock the bonnet halves closed. Reversing the actuation of the piston 84 unlocks the packer.

FIG. 8 is a side section view of the packer 70 taken along section B—B of FIG. 6. The packer 70 operates in a manner similar to the packer of FIG. 1, but it has certain structural distinctions. Note that the cylinders 74*a* and 74*b* are connected to their respective bonnet halves, rather than being connected to a pedestal, as in FIG. 1. In this embodiment, the cylinders 74*a* and 74*b* travel with the bonnet halves as the packer is opened and shut. This also means that the piston rods 78*a* and 78*b* are coupled to a body 90 in order to provide relative motion between the bonnet halves and the body 90. Another feature of this embodiment of the present invention includes a single retention ring 92*a* and 92*b*, in contrast to the multiple rings 48 and 50 of FIG. 1.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A stripper/packer comprising:

a. a body with a bore extending through the body;

b. a first bonnet half and a second bonnet half;

c. a first hydraulic actuator coupling the body to the first bonnet half and a second hydraulic actuator coupling the body to the second bonnet half to provide relative motion between the body and the first and second bonnet halves;

d. a packer chamber between the body and the bonnet halves; and e. a packer element within the chamber.

2. The stripper/packer of claim 1 wherein each of the first and second hydraulic actuators comprises:

a. a horizontally oriented rod;

b. a piston coupled to the rod; and c. a cylinder enclosing the piston and the rod.

3. The stripper/packer of claim 2 wherein the rod of the first hydraulic actuator is connected to the first bonnet half and the rod of the second hydraulic actuator is connected to the second bonnet half.

4. The stripper/packer of claim 2 wherein each of the rods is connected to the body.

5. The stripper/packer of claim 1 further comprising:

a. a retention ring around the body;

b. a mating retention groove on the first bonnet half that mates with a portion of the retention ring around the body; and c. a mating retention groove on the second bonnet half that mates with another portion of the retention ring.

6. The stripper/packer of claim 1 further comprising a first pedestal extending from the body to support the first hydraulic actuator and a second pedestal extending from the body to support the second hydraulic actuator.

7. The stripper/packer of claim 1 further comprising a locking mechanism to lock the first and second bonnet halves to the body.

8. The stripper/packer of claim 7 further comprising a first pedestal extending from the body to support the first hydraulic actuator and a second pedestal extending from the body to support the second hydraulic actuator.

9. The stripper/packer of claim 8 wherein the locking mechanism comprises a first removable sleeve that fits between the first pedestal and the first bonnet half and a second removable sleeve that fits between the second pedestal and the second bonnet half.

10. The stripper/packer of claim 7 wherein the locking mechanism comprises:

a. a first plate extending from the first bonnet half, the plate having a hole therethrough;

b. a second plate extending from the second bonnet half, the plate having a hole therethrough; and c. a pin to removably extend through the hole in the first plate and the hole in the second plate.

11. The stripper/packer of claim 10 further comprising:

a. a piston rod coupled to the pin;

b. a piston coupled to the piston rod; and c. a hydraulic cylinder surrounding the piston rod and the piston to hydraulically actuate the pin.

12. In a stripper/packer having a body with a bore therethrough, a pair of opposed, hydraulically actuated bonnet halves, a packer chamber between the body and the bonnet halves, a packer element within the chamber, and a hydraulically actuated means of compressing the packer element, a method of sealing the packer element around a tubular member extending through the bore, the method comprising the steps of:

a. actuating the pair of bonnet halves until the bonnet halves are in contact with each other;

b. locking the bonnet halves together; and c. actuating the means of compressing the packer element to seal the packer element around the tubular member.

13. In a stripper/packer having a body with a bore therethrough, a pair of opposed, hydraulically actuated bonnet halves movably coupled to and above the body, a packer chamber between the body and the bonnet halves, and a packer element within the chamber, a method of retaining the packer element within the packer chamber, the method comprising the steps of:

a. actuating the pair of bonnet halves toward each other until the bonnet halves are in contact with each other; and b. locking the bonnet halves together, thereby closing off the packer chamber between the body and the bonnet halves to retain the packer element within the packer chamber.

* * * * *